US006403021B1

(12) United States Patent
Fujita et al.

(10) Patent No.: US 6,403,021 B1
(45) Date of Patent: Jun. 11, 2002

(54) METHOD OF CONSTRUCTING A BLAST FURNACE BODY AND LIFTING TRANSFER APPARATUS

(75) Inventors: Masao Fujita; Hirotaka Kojima, both of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/538,810

(22) Filed: Mar. 30, 2000

(30) Foreign Application Priority Data

Mar. 31, 1999 (JP) ..... 11-090416

(51) Int. Cl.[7] ..... C21B 13/06
(52) U.S. Cl. ..... 266/44; 266/DIG. 1; 266/143
(58) Field of Search ..... 266/44, DIG. 1, 266/142, 143

(56) References Cited

U.S. PATENT DOCUMENTS 4,064,616 A 12/1977 Kubota et al.

FOREIGN PATENT DOCUMENTS

| | | | |
|---|---|---|---|
| DE | 3743745 | 5/1989 | |
| EP | 01820511 | 5/1986 | |
| JP | 405222420 A * | 8/1993 | ..... 266/DIG. 1 |

OTHER PUBLICATIONS

Fujita M et al: "Short Term Revamping of No. 6 Blast Furnace in Chiba Works" Cahiers D'Informations Techniques de la Revue de Matallurgie, FR, Revue de Metallurgie. Paris, vol. 96, No. 3, Mar. 1999; pp. 349–357.

* cited by examiner

*Primary Examiner*—Scott Kastler
(74) *Attorney, Agent, or Firm*—Schnader Harrison Segal & Lewis LLP

(57) ABSTRACT

A method and lifting transfer apparatus for dismantling an existing blast furnace body by dividing it into a plurality of furnace-body ring blocks, and efficiently transporting each of the ring blocks to and from a furnace-body disassembly site and back to the hearth for assembly of a repaired or rebuilt furnace body.

9 Claims, 21 Drawing Sheets

FIG. 14A
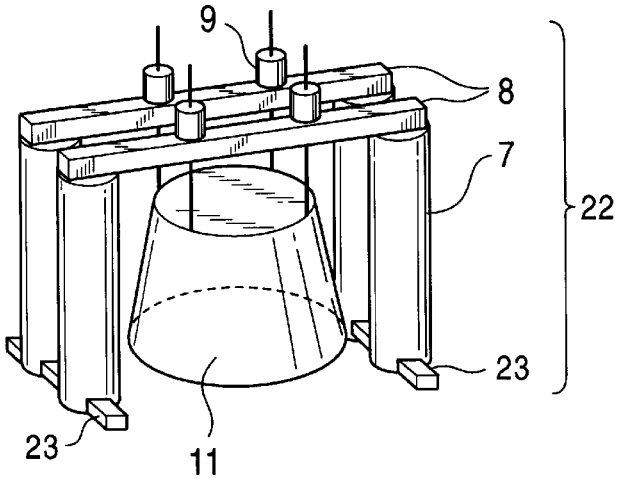
FIG. 14B'
FIG. 14B
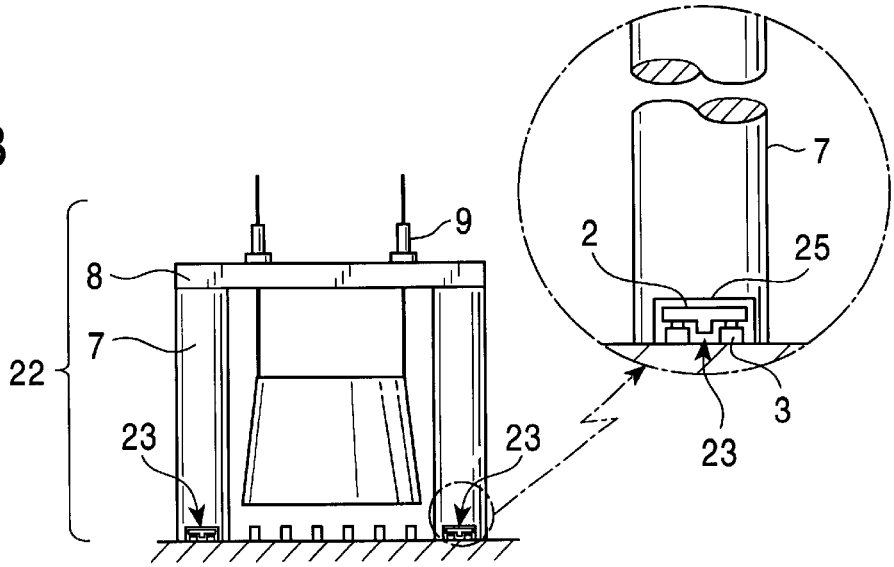
FIG. 14C
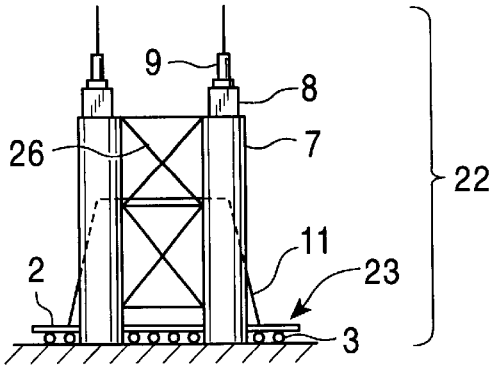

METHOD OF CONSTRUCTING A BLAST FURNACE BODY AND LIFTING TRANSFER APPARATUS

BACKGROUND OF THE INVENTION

1. Field of the Invention

The present invention relates to a method of constructing or reconstructing a blast furnace body using a ring block technique in which the blast furnace body is divided into a plurality of sections that are movable to and from the blast furnace hearth site.

A lifting transfer apparatus is provided for lifting and transferring the relevant furnace-body ring sections, or blocks.

The present invention is applicable to dismantling the existing blast furnace body, followed by efficiently either reconstructing another blast furnace body on the same hearth foundation, or newly constructing a blast furnace body on the same site.

2. Description of the Related Art

A conventional method of constructing a blast furnace body comprises the steps of (1) dividing a furnace body shell into small blocks, (2) assembling the furnace body shell at a blast-furnace assembly site by welding, (3) bringing a large number of staves, about 400 to 600 pieces, into the furnace one by one, (4) mounting the staves in predetermined positions, and (5) laying bricks in the furnace. Reconstruction of a blast furnace body in this manner has required a working period of 100 to 130 days.

On the other hand, a so-called furnace-body large ring block technique has been employed recently. This comprises the steps of (1) dismantling a furnace body into ring-shaped units (ring blocks) including a shell, staves and refractories all together, (2) disassembling, repairing and assembling the ring blocks at another site, (3) bringing each of the assembled ring blocks to a blast-furnace assembly site, and (4) connecting and assembling the ring blocks. This construction technique enables a blast furnace body to be reconstructed in a shorter period of not longer than 70 days.

Japanese Examined Patent Publication No. Sho 47-1846 discloses such a technique comprising the steps of (1) dividing a blast furnace into furnace-body ring blocks such as a hearth section, a bosh section, a shaft section, and a top-ring section, (2) constructing the divided furnace-body ring blocks on scaffolds each installed around the blast furnace, the scaffolds having a height that is equal to the height at which the corresponding ring block is to be assembled into the blast furnace, and (3) stacking the furnace-body ring blocks on the foundation of the blast furnace, one above another, while moving around the blast furnace horizontally for each step of stacking each ring block. This is done by using a movable scaffold, and then integrating all the ring blocks into an integral structure.

Also, Japanese Examined Patent Publication No. Sho 53-39322 discloses a technique comprising the steps of (1) dividing a blast furnace into several furnace-body ring blocks, and constructing those ring blocks at a site other than the foundation of the blast furnace, (2) assembling the divided furnace-body ring blocks one by one from the top section using a lifting technique which utilizes an associated tower provided on furnace-body support posts for construction of the blast furnace, and (3) fixing the hearth section on the foundation of the blast furnace along with a hearth base.

The conventional ring block techniques described above require working at a high altitude. The work involves assembling each of the ring blocks on a stand at a height up to about 7 meters above the ground surface. Such work at an elevated level not only necessarily pushes up the cost because of the expense of the stand, but requires improvement from the viewpoint of safety. Regardless of the size scales of the blast furnaces, the foundation of any blast furnace body usually requires an upper end height at about 4 to 6 meters. This is because the blast furnace is installed at a high level so that molten iron coming out of the tapping hole of the blast furnace will flow down through a sloped runner. The flowing steel is then introduced into a torpedo car, or a ladle or the like for carrying the molten iron for processing or use.

When dismantling or constructing or reconstructing a blast furnace using the furnace-body ring block technique, furnace-body ring blocks weighing about 1000 to 2000 tons are each moved from or onto the foundation of the furnace body at a level of about 7 meters above the ground surface for a blast furnace having a capacity of about 4000 to 5000 $m^3$. Accordingly, horizontal beams each having a height of 1 to 2 meters are required for supporting the weight of the ring block. Further, when dismantling a blast furnace, the furnace-body ring blocks must be transported from a level of about 7 meters to a furnace-body disassembly site at a lower level. Conversely, when constructing a blast furnace, the furnace-body ring blocks, which have been assembled at a furnace-body ground assembly site at a lower level, must be raised up to a level of about 7 meters above the ground surface and then moved onto the supporting foundation of the furnace body.

A furnace-body carriage car having a height of about 1.5 meters and being able to raise and lower an upper surface is employed to transport the furnace-body ring block. Even with a packing beam mounted on the furnace-body carriage car for dispersion of the ring block weight, however, the total height is only about 3 meters and there still remains a level difference of 4 meters relative to the foundation of the furnace body. A load level-adjusting framework is required to absorb such a level difference. It is necessary to prepare the load level-adjusting framework in number corresponding to the numbers of divided ring blocks to be dismantled and the number of furnace-body ring blocks newly fabricated. Further, since the furnace-body ring blocks are moved on the load level-adjusting framework, the adjusting framework is required to have rigidity enough to endure the weight of each furnace-body ring block throughout its entire length. Thus, the furnace-body ring block technique is a method enabling a blast furnace to be reconstructed in a shorter period, but faces a difficulty in practical use because of the high production cost of the load level-adjusting framework.

To overcome the above-described problem, Japanese Unexamined Patent Publication No. Hei 10-102778 discloses a stationary lifting transfer apparatus for lifting and lowering a furnace-body ring block is installed in an appropriate place outside a blast furnace. When dismantling furnace-body ring blocks, each furnace-body ring block is moved onto a furnace-body carriage car and then transported to a stationary lifting transfer apparatus. A load level-adjusting framework in match with a level higher than the foundation of a blast furnace body is set on the furnace-body carriage car. Thereafter, the furnace-body ring block is lifted by the stationary lifting transfer apparatus, and the load level-adjusting framework is removed from the furnace-body carriage car. Subsequently, the furnace-body ring block is lowered and placed directly on the furnace-body carriage car. The furnace-body ring block is then transported onto a rest stand for storage. On the other hand, a newly fabricated furnace-body ring block is assembled at a ground assembly site at a low level, loaded on the furnace-body carriage car and then transported to the stationary lifting transfer apparatus. After that, the furnace-body ring block is lifted by the stationary lifting transfer apparatus to a level allowing the furnace-body ring block to be moved onto the foundation of the blast furnace body. Subsequently, the furnace-body ring block is loaded on the furnace-body carriage car on which the load level-adjusting framework is positioned, and then transported to the foundation of the blast furnace body.

DETAILED DESCRIPTION OF THE PRIOR ART

The method of constructing a blast furnace body disclosed in the above-cited Japanese Unexamined Patent Publication No. Hei 10-102778 will be described below in more detail. In the disclosed method, a furnace-body carriage car having a structure as shown in FIGS. 1A and 1B of this application is employed. FIG. 1A is a side view and FIG. 1B is a front view. The furnace-body carriage car 1 includes a car body 2 having a rectangular flat upper surface. A multiplicity of wheels 3 with pneumatic tires are arranged under the car body 2, allowing the carriage car 1 to travel on the surface of the ground. A hydraulic lifting/lowering cylinder 4 is disposed over each axle so that the car body 2 is movable up and down. Further, each wheel 3 has a structure enabling the wheel to swing horizontally about a vertical axis 5. The structure for swinging the wheel 3 may be hydraulic, electric or mechanical (e.g., rack-and-pinion) mechanisms. Therefore, the direction in which the furnace-body carriage car 1 travels can be freely changed by swinging the wheels 3 as desired. There are two types of furnace-body carriage cars 1, i.e., the self-propelled type including a drive unit which enables the carriage car to travel back and forth, and the separately driven type having no drive unit. The furnace-body carriage cars 1 are longitudinally coupled with each other in use, and the total length can be adjusted by selecting the number of carriage cars coupled in tandem. Also, even a furnace-body ring block having a large width can be handled by arraying a plurality of furnace-body carriage cars side by side.

FIGS. 2A and 2B show a ring-block lifting transfer apparatus. FIG. 2A is a perspective view and FIG. 2B is a plan view. As shown in FIG. 2A, a stationary lifting transfer apparatus 6 is made up of four posts 7 fixedly installed on the ground and arranged at four corners of a rectangular zone as viewed from above, and two horizontal beams 8. As shown in FIG. 2B, the two horizontal beams 8 are each laid to extend between two of the four posts 7, having a longer span between them at top ends thereof. The horizontal beams 8 are positioned at a height in excess of 20 meters. This height is required to lift up the furnace-body ring block to such a level as allowing the ring block to be loaded on the furnace-body carriage car on which a load level-adjusting framework is set. On the two horizontal beams 8, lift jacks 9 are disposed at spaced positions in such a number as is required. In FIG. 2, a total of four lift jacks 9, i.e., two on each horizontal beam, are disposed. Also, as shown in FIG. 2, the four posts 7 are arranged at four corners of a rectangular zone as viewed from above. The horizontal spacing between two posts having a longer span therebetween is selected to be greater than the maximum diameter of the furnace-body ring blocks.

Specifically, the above horizontal spacing is set to a span of about 25 meters, for example, so that all the furnace-body ring blocks can be carried into the lifting transfer apparatus between the posts. The posts 7 having a shorter span between them are coupled with each other by a connecting structure 26 (FIG. 2B).

When constructing a blast furnace body by using furnace-body ring blocks newly fabricated, furnace-body ring blocks 11 (see FIGS. 3A–3D) are each assembled at a ground assembly site so as to lie on rest stands 10 having a height of about 3 meters (for example) above the ground surface, and are held in a standby mode. As shown in FIGS. 3A to 3D, the furnace-body ring blocks 11 have different shapes and sizes depending on the specified furnace design of the furnace body from the hearth to the top. When the furnace-body ring blocks 11 are held on standby, each ring block is supported on a rest stand 10 arranged at about ten positions, for example for dispersion of the ring block weight. Note that, in the ground assembly site, the needed procedures are performed for integrating a shell, staves, furnace-body bricks and stave connecting pipes, including even instrument units to be installed in the furnace body into an integral structure.

The furnace-body ring block 11 assembled at a ground assembly site is, as shown in FIG. 4, supported on a rest stand 10 arranged at predetermined support points. To transport the furnace-body ring block 11 to the construction site, the number of rest stands 10 supporting the ring block is reduced so that the ring block is supported by the rest stands at the smallest number of necessary points.

FIG. 5 shows an example in which the furnace-body ring block 11 is supported by the rest stands 10 at only four points.

Then, as shown in FIG. 6, four furnace-body carriage cars 1 are provided in the gaps below the furnace-body ring block 11 so as to lie side by side, spaced without interference with the rest stands 10. FIG. 6A is a front view looking from a position ahead in the direction of travel of the carriage cars, and FIG. 6B is a plan view. A packing beam 12 is placed on the furnace-body carriage car 1 in order to disperse the block weight over the entire length of the carriage car. At this time, the height of the furnace-body carriage car 1 is positioned lower than that of the rest stands 10. The car body 2 is raised with operation of the raising/lowering cylinders 4 shown in FIG. 1. The height of the furnace-body carriage car 1 is thereby increased to support the furnace-body ring block 11 through the packing beam 12. The rest stands 10 are then removed.

The furnace-body carriage cars 1, including the furnace-body ring block 11 loaded on it through the packing beam 12, are moved in the direction indicated by the arrow in FIG. 7, and then stopped at the installation position of the stationary lifting transfer apparatus 6 after passing under the horizontal beams 8 each extending between the posts 7 having the longer span there between. The furnace-body ring block 11 on the furnace-body carriage cars 1 at the stopped position is shown in FIG. 8A that is a front view looking from a position ahead in the direction of traveling of the carriage cars, and FIG. 8B that is a plan view. As shown in FIGS. 8A and 8B, the furnace-body ring block 11 on the furnace-body carriage cars 1 has hanger brackets 13 attached to a lower end of its side, and slings 24 suspending from the lift jacks 9 are connected to the hanger brackets 13. Then, as shown in FIG. 9, the lift jacks 9 are driven to hang up the furnace-body ring block 11, and the furnace-body carriage cars 1 are moved back in the direction of the arrow in FIG. 9. Subsequently, as shown in FIG. 10, the furnace-body ring block 11 is further lifted up until a lower surface of the furnace-body ring block 11 lies at a level of 7 meters or more above the ground surface. The furnace-body carriage cars 1 are then moved into a position below the furnace-body ring block 11. Now, a load level-adjusting framework 14 is set on each furnace-body carriage car 1 through the packing beam 12. The load level-adjusting framework 14 is made up of an adjusting framework body 27, rails 16 arranged on the adjusting framework body 27, and a movable platform 19 having support blocks 18 disposed on the rails 16.

Next, as shown in FIG. 11, the lift jacks 9 are driven reversely to lower the furnace-body ring block 11, whereby the furnace-body ring block 11 is loaded on the load level-adjusting frameworks 14 set on the furnace-body carriage cars As shown in FIG. 12, the furnace-body ring block 11 on the load level-adjusting framework 14 positioned on the furnace-body carriage cars 1 is transported to a position near the foundation 15 of the blast furnace body, and the rails 16 provided on an upper surface of the load level-adjusting frameworks 14 are connected to rails 17 provided on the foundation 15 of the blast furnace body. The furnace-body ring block 11 on the movable platform 19 including the support blocks 18 disposed on the underside thereof is moved horizontally in the direction of the FIG. 12 arrow by the operation of drive cylinders 20. The mount position of each drive cylinders 20 can be changed such that the drive cylinder 20 are advanced step by step following the movement of the furnace-body ring block 11. In this way, the furnace-body ring block 11 is progressively moved from the rails 16 to the rails 17 and is finally positioned at the center of the foundation 15 of the blast furnace body.

Subsequently, the furnace-body ring block 11 is lifted up with slings 21 suspending from lift equipment (not shown) provided on posts of the blast furnace body. At this time, the furnace-body ring block 11 is lifted up to a level at which there is space enough to allow another furnace-body ring block to be next transported to move onto the foundation 15 of the blast furnace body, below the lifted-up furnace-body ring block 11. Also, the movable platform 19 is removed along with the support blocks 18 from the rails 17.

Likewise, the next furnace-body ring block 11 is moved into under the preceding lifted-up furnace-body ring block 11. These two upper and lower furnace-body ring blocks 11 are joined together and then further lifted up. The blast furnace body is completed by repeating the above-described process a number of times corresponding to the number of ring blocks newly fabricated, and integrating the stacked ring blocks into an integral structure on the foundation of the blast furnace body.

Since the newly fabricated furnace-body ring block 11 has a maximum weight of about 2000 tons, the ring blocks 11 are each assembled, as shown in FIG. 3, on a multiplicity of rest stands 10 arranged on the ground surface of the furnace-body ground assembly site. To load the assembled furnace-body ring block 11 on the furnace-body carriage cars 1, the rest stands 10 are required to have a height greater than that of the furnace-body carriage cars 1. Usually, unless the rest stands 10 have a height of 3 meters or more, the furnace-body carriage cars 1 cannot be brought under the furnace-body ring block 11. In other words, the process for assembling the furnace-body ring block 11 must be performed at an elevated level of 3 meters or more.

Further, to bring the furnace-body carriage cars 1 into a position under the rest stands 10 on which the furnace-body ring block 11 is placed, the number of rest stands 10 must be reduced to increase the span between the arranged rest stands so that the rest stands do not interfere with paths along which the furnace-body carriage car 1 is moved. At the same time, it is also required to determine the number and arrangement of the rest stands 10 necessary for supporting the furnace-body ring block 11, taking into account deformation of the furnace-body ring block 11 to avoid losing fabrication accuracy. Thus, there are various restrictions on the number and arrangement of the rest stands.

Moreover, the step of loading the furnace-body ring block 11 on the furnace-body carriage cars 1 takes substantial time. It further takes substantial time to set the load level-adjusting frameworks 14 between the furnace-body carriage cars 1 and the furnace-body ring block 11 after transporting the furnace-body ring block 11 to the stationary lifting transfer apparatus 6 together with the furnace-body carriage cars 1. In addition, the load level-adjusting framework must be set on and removed from the furnace-body carriage cars repeatedly whenever each furnace-body ring block is transported. For those reasons, the above-described method has been difficult to implement with good efficiency.

When dismantling the existing furnace body from a top section to a hearth section by dividing it into a plurality of furnace-body ring blocks, the operation is carried out in a reverse manner. In that case, the furnace-body ring block 11 placed on the load level-adjusting frameworks 14, which are set on the furnace-body carriage cars 1, is lifted up by the stationary lifting transfer apparatus 6. After removing the load level-adjusting frameworks 14, the furnace-body ring block 11 must be lowered to be loaded on the furnace-body carriage cars 1 again. Also, the dismantling operation is similarly troublesome because of restrictions imposed on the positions of the rest stands 10 and the necessity of due consideration for avoiding interference of the rest stands 10 with paths along which the furnace-body carriage cars 1 are moved.

Additionally, since the furnace-body ring blocks have different shapes and sizes, as shown in FIGS. 3A to 3D, the ring blocks are hung at different positions for each block. In other words, in the furnace-body lifting transfer apparatus wherein jacks for lifting the furnace-body ring block are fixed in position, the jacks cannot often be arranged in vertically aligned relation to the hanging points of the ring block. To install the ring block with good accuracy, the ring block must be kept in an exactly horizontal state. However, if the jacks are not arranged in vertically aligned relation to the hanging points of the ring block, a long time is required for horizontal level adjustment.

It has been therefore proposed to employ a hanger beam 31 shown in FIG. 13. More specifically, the hanger beam 31 has such a structure that block hanging positions 32 are movable and positions 33 at which the hanger beam 31 is hung by the jacks are fixed. Horizontal level adjustment of the ring block is facilitated by employing the hanger beam 31. However, because the lifting load is on the order of about 2000 tons and the load must be lifted up over a span of about 15 meters, a very high production cost is encountered. Moreover, each time the block hanging positions are changed, the hanger beam must be lifted up and down for position adjustment. Thus, even with the use of the hanger beam 31, the conventional method still needs time-consuming processing, a lot of labor and predetermined work sites, and is therefore troublesome.

SUMMARY OF THE INVENTION

An object of the present invention is to solve the problems of the related art disclosed in the above-cited Japanese Unexamined Patent Publication No. Hei 10-102778, and to provide a method of constructing a blast furnace body and a lifting transfer apparatus, which can improve the efficiency of the dismantling and assembling of the blast furnace body, done by dividing the furnace body from a top section to a hearth section into a plurality of furnace-body ring blocks.

More specifically, the present invention provides a method of constructing a blast furnace body, which is employed to dismantle and assemble the blast furnace body in a shorter period of time and at a lower cost, done by dividing the blast furnace body from a top section to a hearth section into a plurality of furnace-body ring blocks. The method comprises the steps of connecting a foundation of the blast furnace body to a carriage car having a loading level aligned with the foundation of the blast furnace body, and moving each of the furnace-body ring blocks there between; and moving each of the furnace-body ring blocks between the furnace-body carriage car and a furnace-body disassembly or ground assembly state by using a lifting transfer apparatus. The present invention also provides a method of constructing a blast furnace body, which is implemented by using a lifting transfer apparatus having a movable body and/or including a movable lifting mechanism.

The preferred form of the lifting transfer apparatus having a movable body comprises four posts arranged at four corners of a rectangular zone as viewed from above; two horizontal beams each laid out to extend between a pair of the posts having a longer span between the paired posts at top ends thereof; and a plurality of lift jacks disposed on each of the horizontal beams. Further, rectangular cut grooves that are open downward are formed at lower ends of the posts to extend along a horizontal line connecting centers of each pair of those posts that have a shorter span between the paired posts; a long rectangular carriage car having a flat upper surface able to freely raise and lower the upper surface and to change direction, and positioned to lie in the rectangular cut grooves formed at the lower ends of the each pair of posts, the carriage car being engaged with the each pair of posts when the upper surface of the carriage car is raised, and to be disengaged from the each pair of posts when the upper surface of the carriage car is lowered; and a lifting-transfer-apparatus carriage car including a load level-adjusting framework set thereon is allowed to move into a position at which a furnace-body ring block is hung by the lifting transfer apparatus to be loaded and unloaded.

On the other hand, in the lifting transfer apparatus including a movable lifting mechanism, the lifting mechanism comprises a lifting jack, and the lifting jack is slidable horizontally and is able to be always positioned in vertically aligned relation to a corresponding hanging point of the furnace-body ring block to be lifted up.

BRIEF DESCRIPTION OF THE DRAWINGS

FIG. 1 shows a known furnace-body carriage car, i.e.

FIG. 2A is a perspective view and FIG. 2B is a plan view;

FIG. 3 shows a situation where a known new furnace-body ring block is placed on rest stands in a furnace-body ground assembly site, i.e.

FIG. 6 shows a situation where the known furnace-body carriage cars are brought into under the new furnace-body ring block out of interference with the rest stands in least necessary number for supporting the new furnace-body ring block, i.e.

FIG. 8 shows a situation where a known new furnace-body ring block is lifted up from the furnace-body carriage cars by the stationary lifting transfer apparatus, i.e.

FIGS. 14A, 14B, 14B' and 14C show a novel movable lifting transfer apparatus of the present invention, i.e., FIG. 14A is a perspective view, FIG. 14B is a front view, FIG. 14B' is an enlargement of a portion marked with a dotted circle, and FIG. 14C is a side view;

FIG. 28A is a front view and FIG. 28B is a plan view;

FIG. 29A is a plan view showing details of the mechanism, FIG. 29B is a plan view showing a jack position when the block diameter is small, and FIG. 29C is a plan view showing a jack position when the block diameter is large; FIG. 30A is a front view and FIG. 30B is a plan view.

DESCRIPTION OF THE PREFERRED EMBODIMENTS OF THIS INVENTION

Figure 1A:
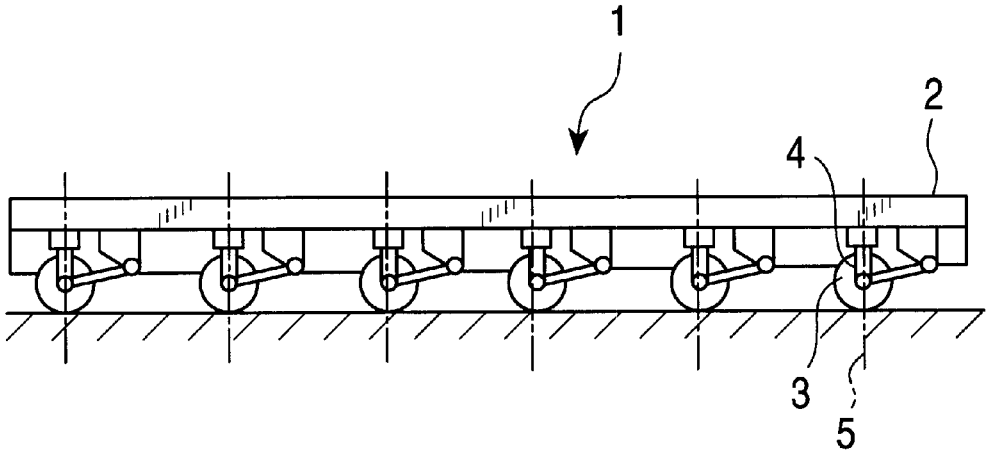
FIG. 1A PRIOR ART
FIG. 1A is a side view and FIG. 1B is a front view.
Figure 1B:
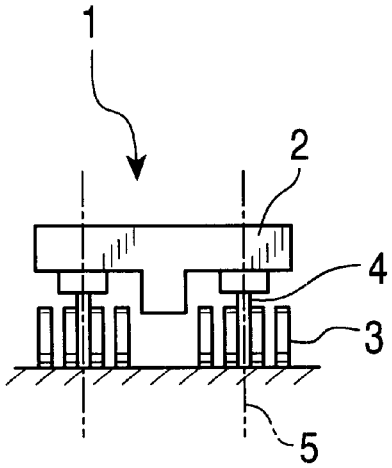
FIG. 1B PRIOR ART
Figure 2A:
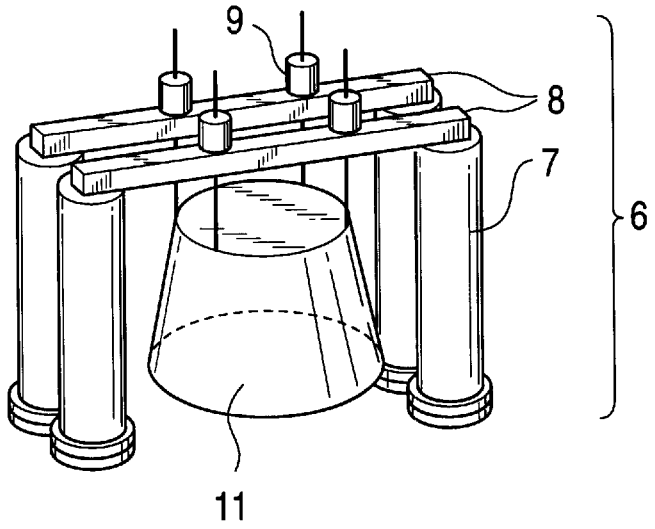
FIG. 2A PRIOR ART
FIGS. 2A and 2B show a conventional stationary lifting transfer apparatus, i.e.
Figure 2B:
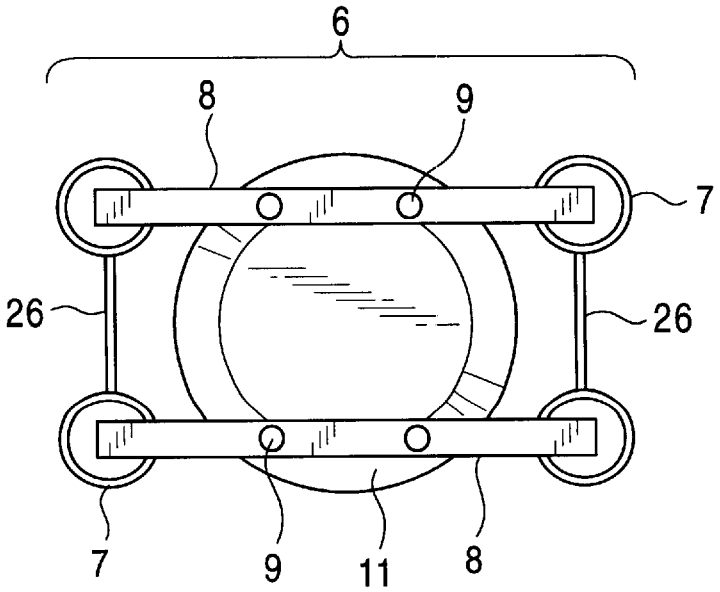
FIG. 2B PRIOR ART
Figure 3A:
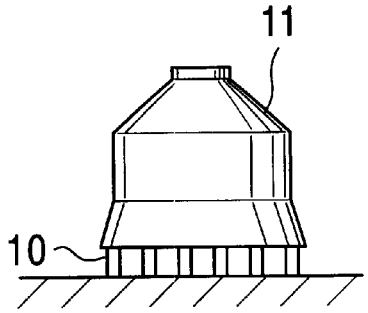
FIG. 3A PRIOR ART
FIGS. 3A to 3D are front views showing various kinds of blocks.
Figure 3B:
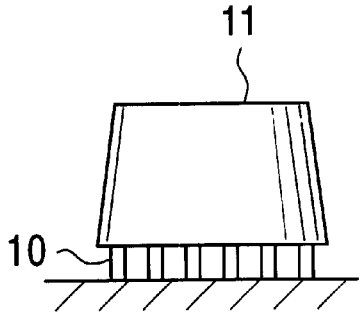
FIG. 3B PRIOR ART
Figure 3C:
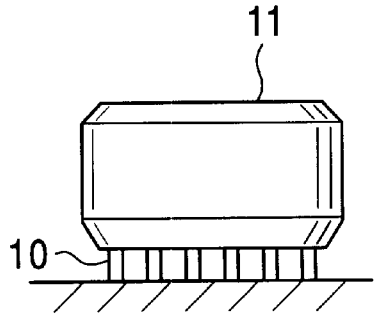
FIG. 3C PRIOR ART
Figure 3D:
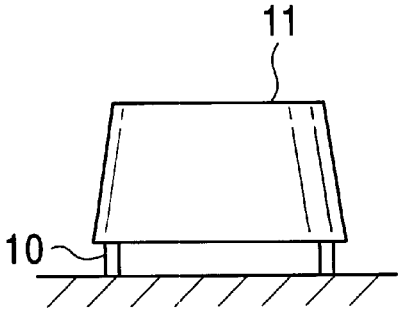
FIG. 3D PRIOR ART
Figure 4:
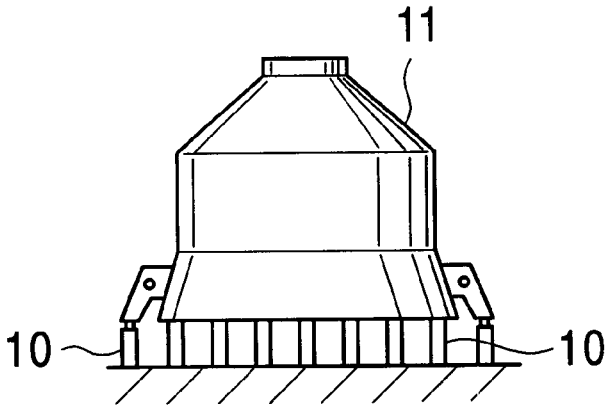
FIG. 4 PRIOR ART
FIG. 4 is a front view showing a situation where a known new furnace-body ring block is placed on and supported by the rest stands in number necessary for dispersion of the block weight in the furnace-body ground assembly site.
Figure 5:
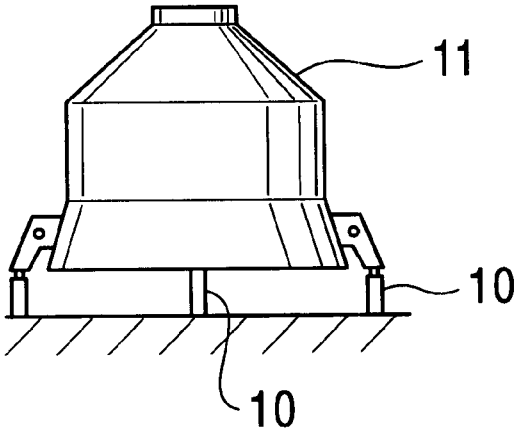
FIG. 5 PRIOR ART
FIG. 5 is a front view showing a situation where the known new furnace-body ring block is placed on and supported. by the rest stands in a minimum necessary number.
Figure 6A:
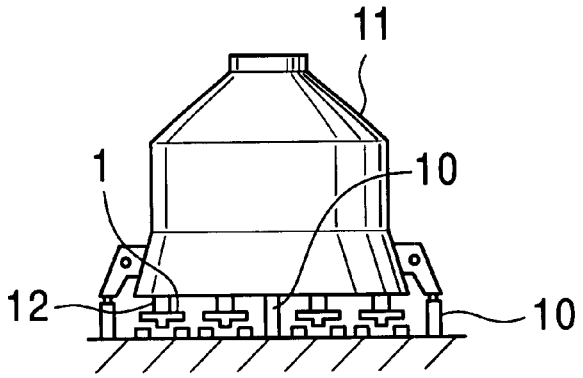
FIG. 6A PRIOR ART
FIG. 6A is a front view and FIG. 6B is a plan view.
Figure 6B:
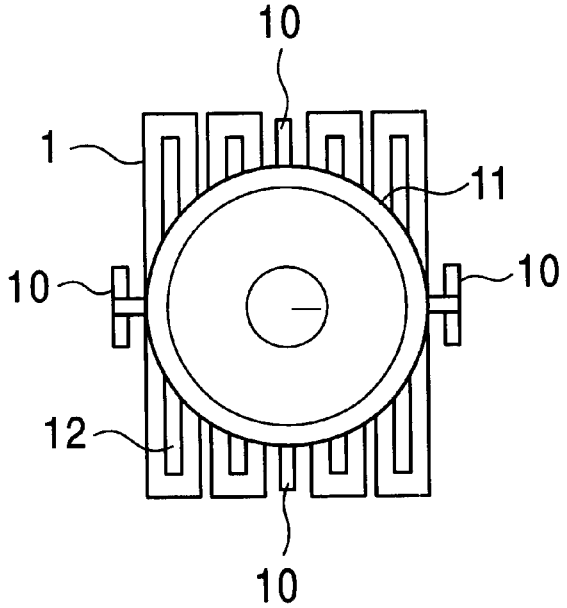
FIG. 6B PRIOR ART
Figure 7:
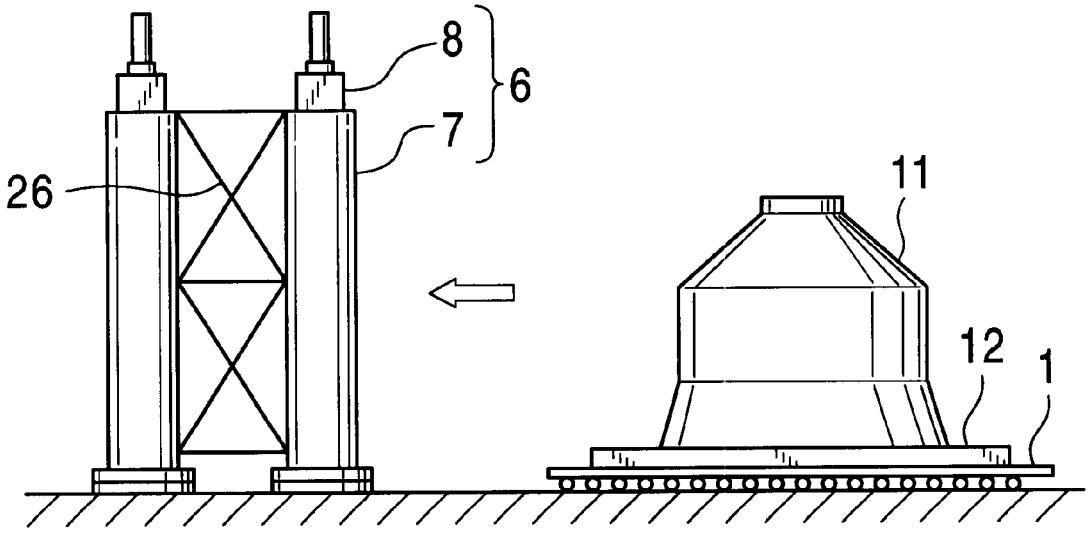
FIG. 7 PRIOR ART
FIG. 7 is a side view showing a situation where a known new furnace-body ring block is loaded on the furnace-body carriage cars and transported toward the stationary lifting transfer apparatus.
Figure 8A:
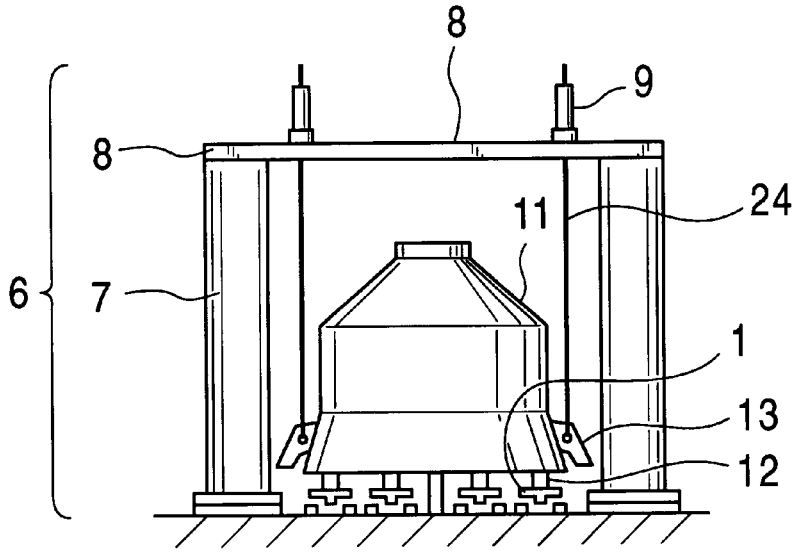
FIG. 8A PRIOR ART
FIG. 8A is a front view and FIG. 8B is a plan view.
Figure 8B:
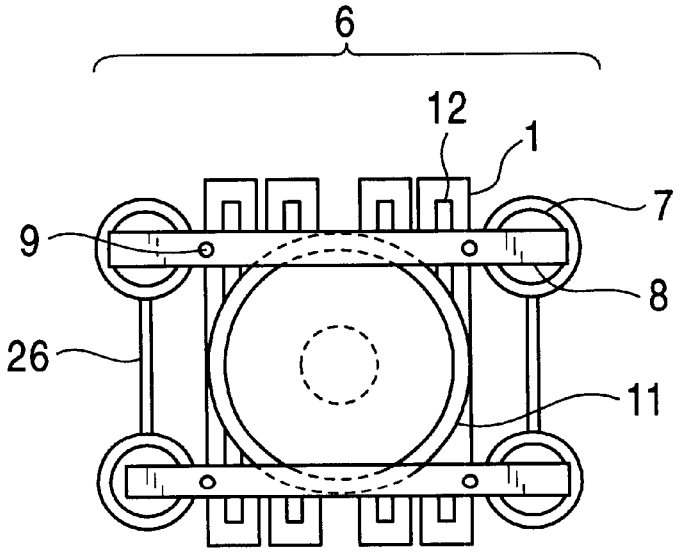
FIG. 8B PRIOR ART
Figure 9:
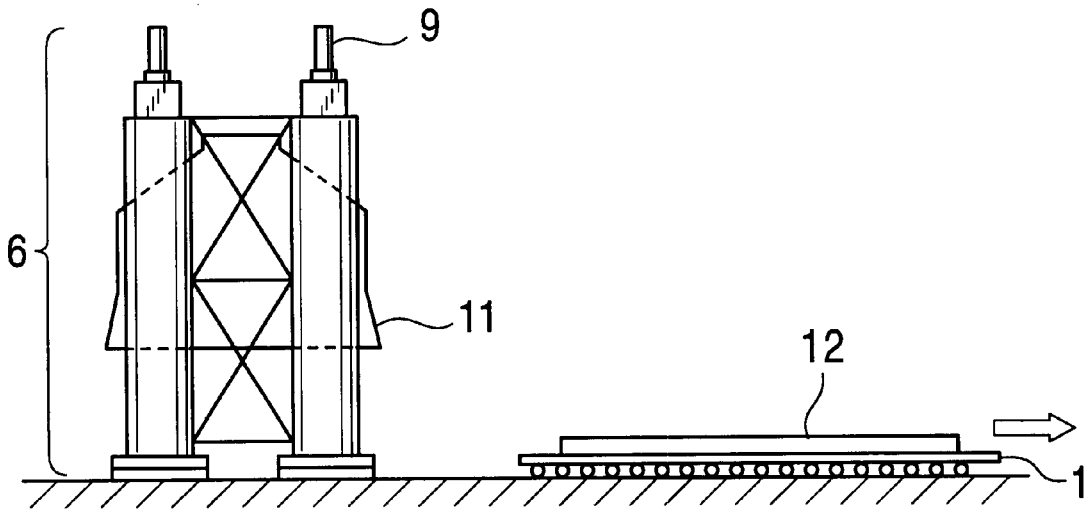
FIG. 9 PRIOR ART
FIG. 9 is a side view showing a situation where the known furnace-body carriage cars are moved away from the new furnace-body ring block lifted up by the stationary lifting transfer apparatus.
Figure 10:
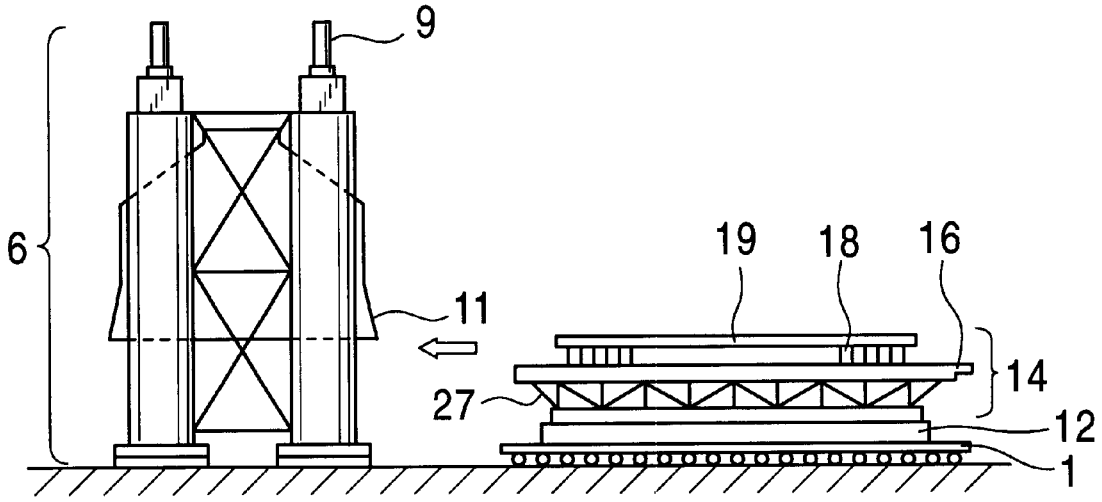
FIG. 10 PRIOR ART
FIG. 10 is a side view showing a situation where the known furnace-body carriage cars are moved to the position of the stationary lifting transfer apparatus while the new furnace-body ring block is lifted up by the stationary lifting transfer apparatus.
Figure 11:
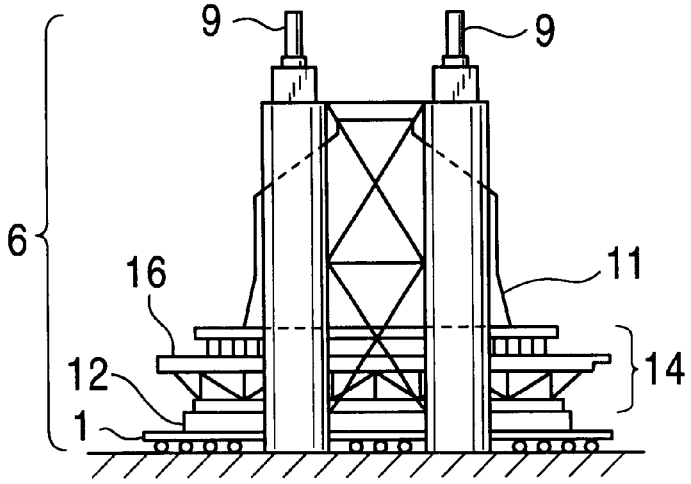
FIG. 11 PRIOR ART
FIG. 11 is a side view showing a situation where the known new furnace-body ring block is loaded on load level-adjusting frameworks set on the furnace-body carriage cars which have been moved into the position of the stationary lifting transfer apparatus.
Figure 12:
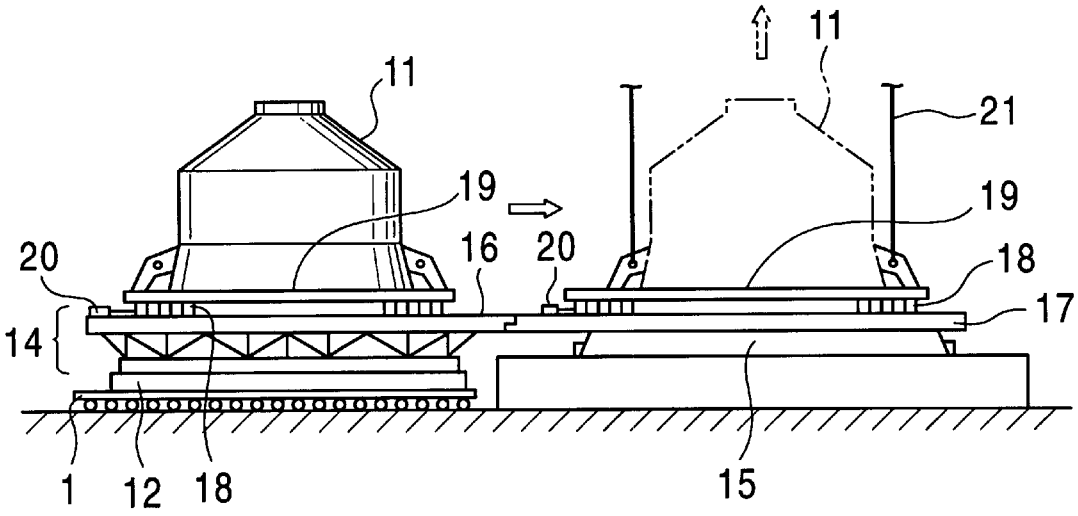
FIG. 12 PRIOR ART
FIG. 12 is a side view showing a situation where the known new furnace-body ring block loaded on the load level-adjusting frameworks set on the furnace-body carriage cars is moved onto the foundation of a blast furnace body.
Figure 13:
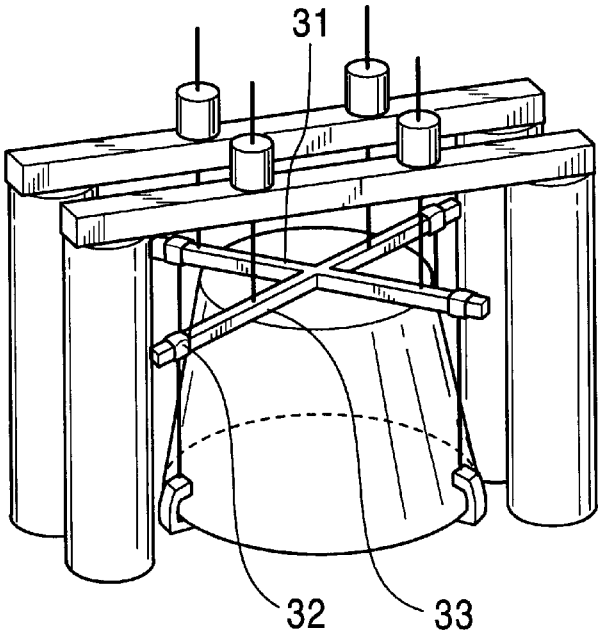
FIG. 13 PRIOR ART
FIG. 13 is a perspective view showing the structure of a conventional lifting transfer apparatus including a hanger beam.

The furnace-body carriage car 1 used for transporting a furnace-body ring block 11 in the present invention can be the same as the conventional one described above with reference to FIG. 1. The load level-adjusting framework 14 positioned on the furnace-body carriage car 1 can be of the same structure as that of the conventional one described above with reference to FIGS. 10 and 11. In accordance with this invention, however, the lifting apparatus is movable.

The movable lifting transfer apparatus 22 shown in FIGS. 14A, 14B and 14C is employed for moving the lifting transfer apparatus itself. It can be moved to a place where the furnace-body ring block 11 is to be lifted up and lowered. Employing the movable lifting transfer apparatus 22 greatly improves the efficiency of blast furnace body construction for dismantling and assembling a blast furnace body by dividing the furnace body, extending from a top section to a hearth section into a plurality of furnace-body ring blocks. FIG. 14A is a perspective view, FIG. 14B is a front view looking in the direction of movement of the movable lifting transfer apparatus, FIG. 14B' is an enlargement, and FIG. 14C is a side view looking in a direction perpendicular to the direction of movement thereof.

The specific form of movable lifting transfer apparatus 22 as shown in FIGS. 14A, 14B, 14B' and 14C is made up of four posts 7 and two horizontal beams 8. The four posts are positioned to provide spans of unequal lengths, two longer and two shorter, extending between the posts. The two horizontal beams 8 are each positioned to extend between a pair of the posts 7 having the longer span between the posts at the top ends thereof. The posts 7 having a shorter span between them are coupled into an integral structure by a structural connecting member 26 (FIG. 14C). These Figures show an example in which the posts 7 are each in the form of a cylindrical column.

On the two horizontal beams 8, a plurality of lift jacks 9 are provided, i.e., two on each horizontal beam. They are disposed at spaced positions in the example of FIGS. 14A, 14B, 14B' and 14C, but the lift jacks 9 may be disposed in any number and configuration as required. The four posts 7 are arranged at four corners of the aforementioned rectangular zone as viewed from above. The furnace-body ring block 11 is brought into the movable lifting transfer apparatus 22 by moving it between those posts 7 having the longer span therebetween, and below the horizontal beams 8, as shown in FIG. 14A. At lower ends of the four posts 7, rectangular cut grooves 25 are formed such that the grooves are open downward and extend along a horizontal line connecting the centers of each pair of those posts 7 having the shorter span between them. The rectangular cut grooves 25 each have such a height and width as to allow a lifting-transfer-apparatus carriage car 23 to enter the groove when the carriage car 23 is adjusted to a reduced height, as will be discussed further. The lifting-transfer-apparatus carriage car 23 is of the same structure as the furnace-body carriage car 1, and therefore both the carriage cars can be used in common.

One set of the lifting-transfer-apparatus carriage cars 23, having a length adjusted to be greater than the spacing between the posts 7 having the shorter span therebetween, are brought into the rectangular cut grooves 25 which are positioned on each side of the shorter span between the posts 7. Thus, two sets of lifting-transfer-apparatus carriage cars 23 are disposed in the movable lifting transfer apparatus 22 in parallel on the left and right sides, as shown. Lower end surfaces of the posts 7 can be raised from the ground surface by increasing the height of the lifting-transfer-apparatus carriage cars 23 with elevation of car bodies 2, while the lower end surfaces of the posts 7 can be rested on the ground surface by decreasing the height of the lifting-transfer-apparatus carriage cars 23 with lowering of the car bodies 2. Each car body 2 is movable up and down by operation of raising/lowering cylinders. In a standby state, the four posts 7 constituting the movable lifting transfer apparatus 22 are rested on the ground surface. When the movable lifting transfer apparatus 22 is moved, the lower end surfaces of the posts 7 constituting the movable lifting transfer apparatus 22 are raised above the ground surface, allowing the movable lifting transfer apparatus 22 to be moved on the lifting-transfer-apparatus carriage cars 23.

Steps of operation for dismantling a blast furnace body by employing the movable lifting transfer apparatus of this invention will be described below in detail.

Figure 15:
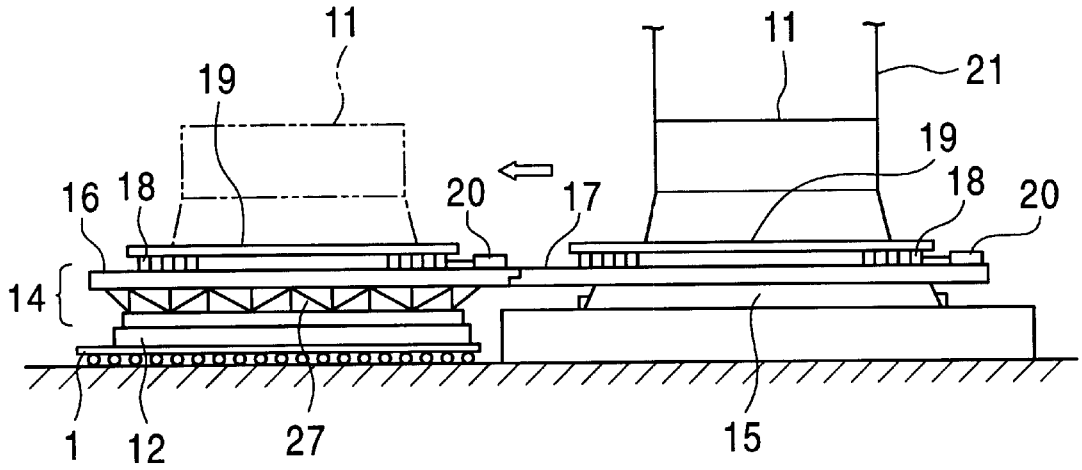
FIG. 15 is a side view showing a situation where a dismantled furnace-body ring block is moved onto load level-adjusting frameworks positioned on furnace-body carriage cars from the foundation of a blast furnace body.

As shown in FIG. 15, the blast furnace body is cut and taken apart into a plurality of furnace-body ring blocks 11 on the foundation 15 of the blast furnace body, and the furnace-body ring blocks 11 are carried out laterally one by one.

More specifically, the furnace-body ring blocks 11 are each lowered and placed on a movable platform 19. The furnace-body ring block 11 is lowered with slings 21 suspended from lift equipment (not shown) provided on posts of the blast furnace body. The movable platform 19 is horizontally movable through support blocks 18 positioned on rails 17 (FIG. 15) that are laid on the foundation 15 of the blast furnace body. Then, the furnace-body carriage cars 1 including the load level-adjusting frameworks 14 mounted thereon are moved to a position near the foundation 15 of the blast furnace body, and rails 16 provided on the load level-adjusting frameworks 14 are connected to the rails 17 provided on the foundation 15 of the blast furnace body. The furnace-body ring block 11 placed on the movable platform 19 is moved horizontally in a direction of the FIG. 15 arrow with operation of drive cylinders 20. The mount position of each drive cylinder 20 can be changed such that the drive cylinder 20 is moved step by step following the movement of the furnace-body ring block 11. In this way, the furnace-body ring block 11 is progressively moved from the rails 17 to the rails 16 and is finally positioned on the furnace-body carriage cars 1, in the position indicated by chain lines 11 at the left in FIG. 15.

Figure 16:
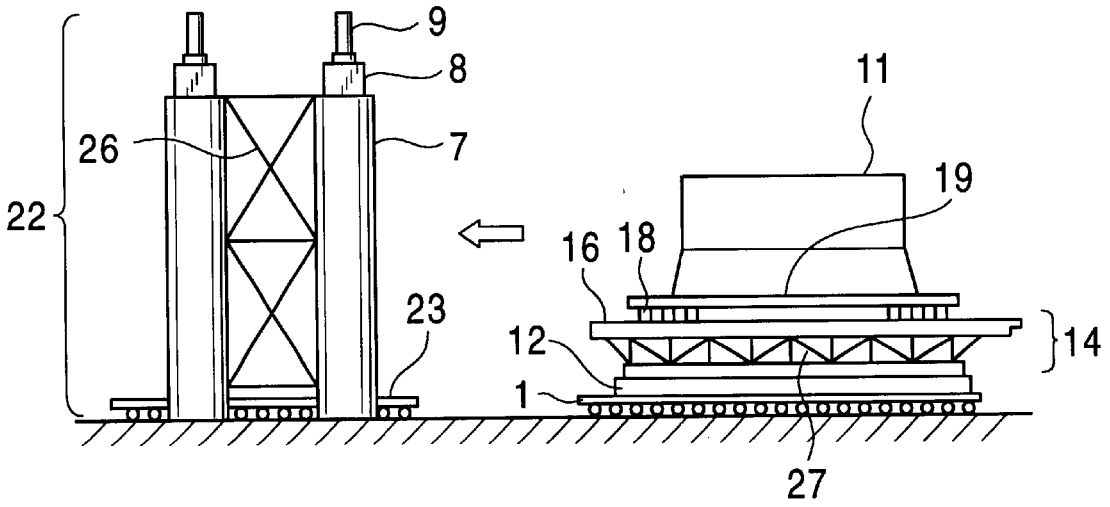
FIG. 16 is a side view according to this invention showing a situation where the dismantled furnace-body ring block, which has been loaded on the load level-adjusting frameworks positioned on the furnace-body carriage cars, is transported toward the movable lifting transfer apparatus.
Figure 17:
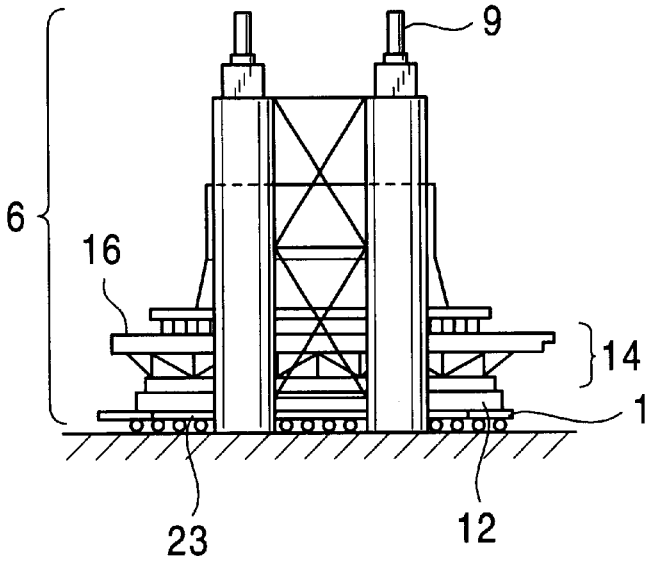
FIG. 17 is a side view according to this invention showing a situation where the dismantled furnace-body ring block, which has been loaded on the load level-adjusting frameworks positioned on the furnace-body carriage cars, is transported to the position of the movable lifting transfer apparatus.
Figure 18:
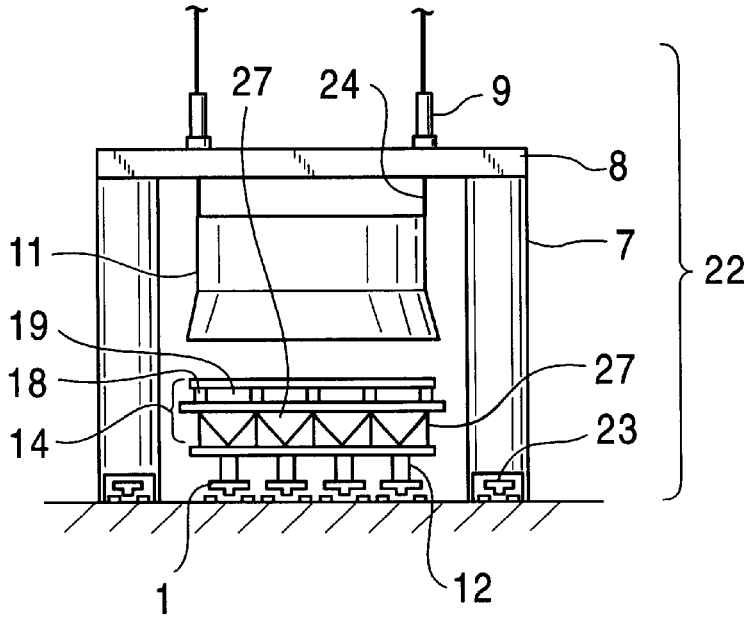
FIG. 18 is a front view according to this invention showing a situation where the dismantled furnace-body ring block is lifted up by the movable lifting transfer apparatus from the load level-adjusting frameworks positioned on the furnace-body carriage cars.
Figure 19:
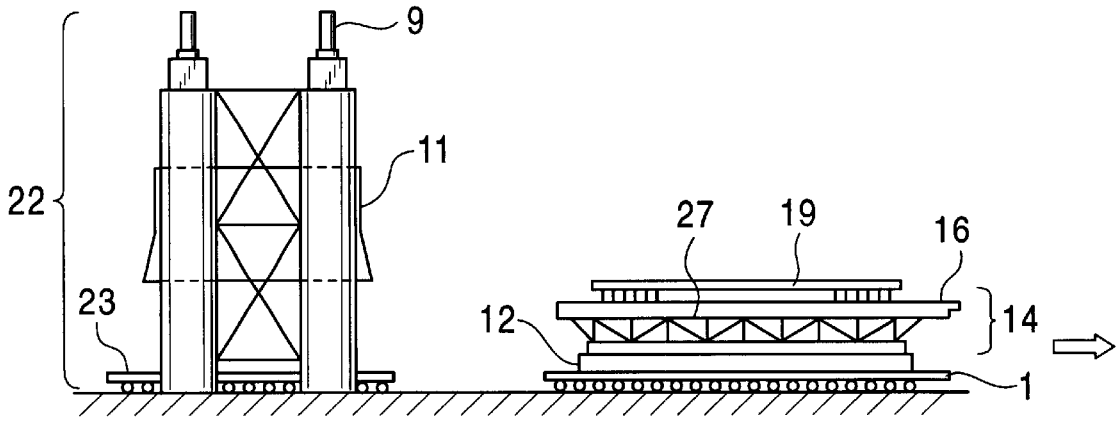
FIG. 19 is a side view according to this invention showing a situation where the dismantled furnace-body ring block is lifted up by the movable lifting transfer apparatus moved to a disassembly site away from the furnace-body carriage cars.
Figure 20:
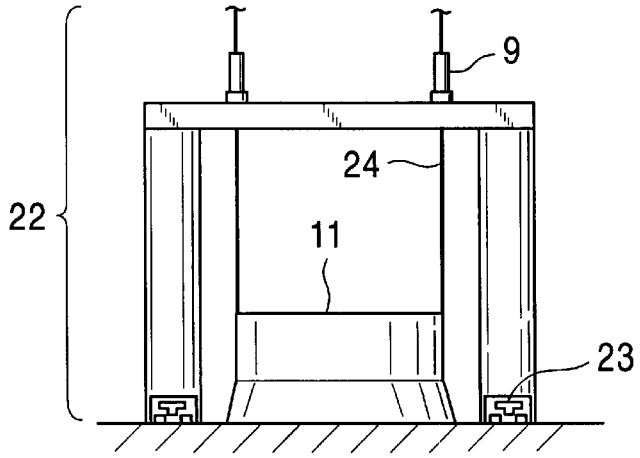
FIG. 20 is a front view showing a situation where the dismantled furnace-body ring block of this invention is lifted down in a furnace-body storage place by the movable lifting transfer apparatus moved to there.
Figure 21:
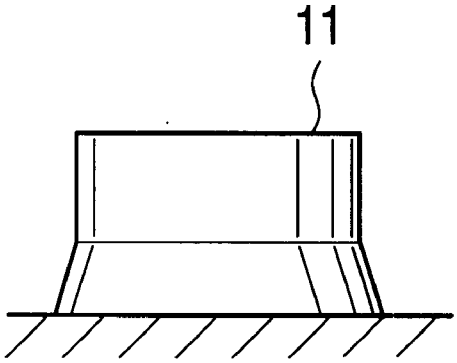
FIG. 21 is a front view showing a situation where the dismantled furnace-body ring block of this invention is rested in the furnace-body storage place.

As shown in FIG. 16, the furnace-body carriage cars 1 including the furnace-body ring block 11 placed on the load level-adjusting frameworks 14 are moved to a furnace-body disassembly site and moved toward the movable lifting transfer apparatus 22 in a standby state. The furnace-body carriage cars 1 are then stopped at the position of the movable lifting transfer apparatus 22 as shown in FIG. 17. The movable lifting transfer apparatus 22 has been moved to a work site and held stationary there beforehand. Thereafter, as shown in FIG. 18, the lift jacks 9 are driven to lift up the furnace-body ring block 11 into a suspended state by the slings 24. Then, as shown in FIG. 19, the furnace-body carriage cars 1 including the load level-adjusting frameworks 14 positioned thereon are moved away from the position of the movable lifting transfer apparatus 22 in a direction of arrow toward a next work site. On the other hand, the furnace-body ring block 11 is lowered to rest directly on the ground surface through the slings 24 with operation of the lift jacks 9, as shown in FIG. 20. After that, the movable lifting transfer apparatus 22 is moved to a next furnace-body disassembly site. Accordingly, as shown in FIG. 21, the dismantled furnace-body ring block 11 is left in the furnace-body storage place.

Steps of operation for constructing a blast furnace body from newly fabricated furnace-body ring blocks by employing the movable lifting transfer apparatus will be described below in detail.

Figure 22:
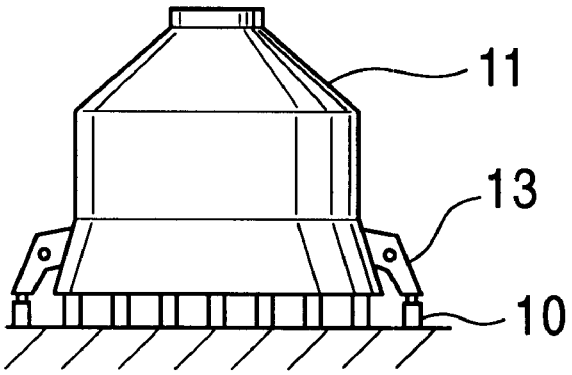
FIG. 22 is a front view showing a situation where a new furnace-body ring block of this invention is placed in a rest condition.

As shown in FIG. 22, the rest stands 10 are arranged in a furnace-body ground assembly site. On this occasion, the height of the rest stands 10 may be placed in selected positions in consideration of convenience for work. The furnace-body ring block 11 is assembled in the ground assembly site so as to lie on the rest stands 10 which can be arranged in any desired number necessary for supporting the furnace-body ring block 11 while dispersing the block weight sufficiently. The furnace-body ring block 11 is assembled such that a shell, staves, furnace-body bricks and stave connecting pipes, including even instrument units to be installed in the furnace body, are integrated into an integral structure. The assembled furnace-body ring block 11 is then held in a standby state.

Figure 23:
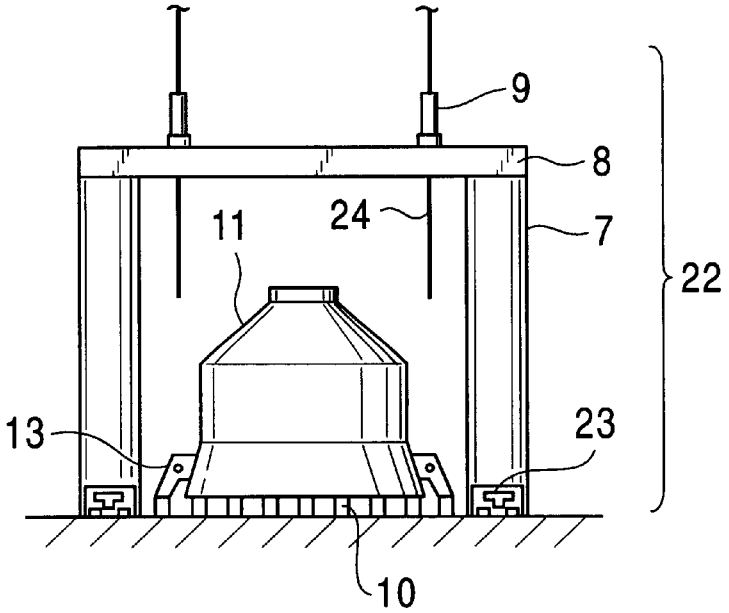
FIG. 23 is a front view according to this invention showing a situation where the movable lifting transfer apparatus is moved to the position of the new furnace-body ring block placed on the rest stands.
Figure 24:
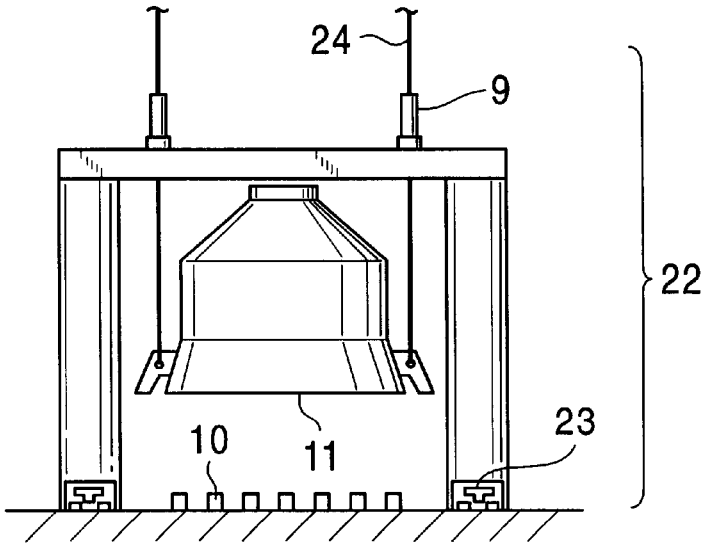
FIG. 24 is a front view according to this invention showing a situation where a new furnace-body ring block placed on the rest stands is lifted up by the movable lifting transfer apparatus.
Figure 25:
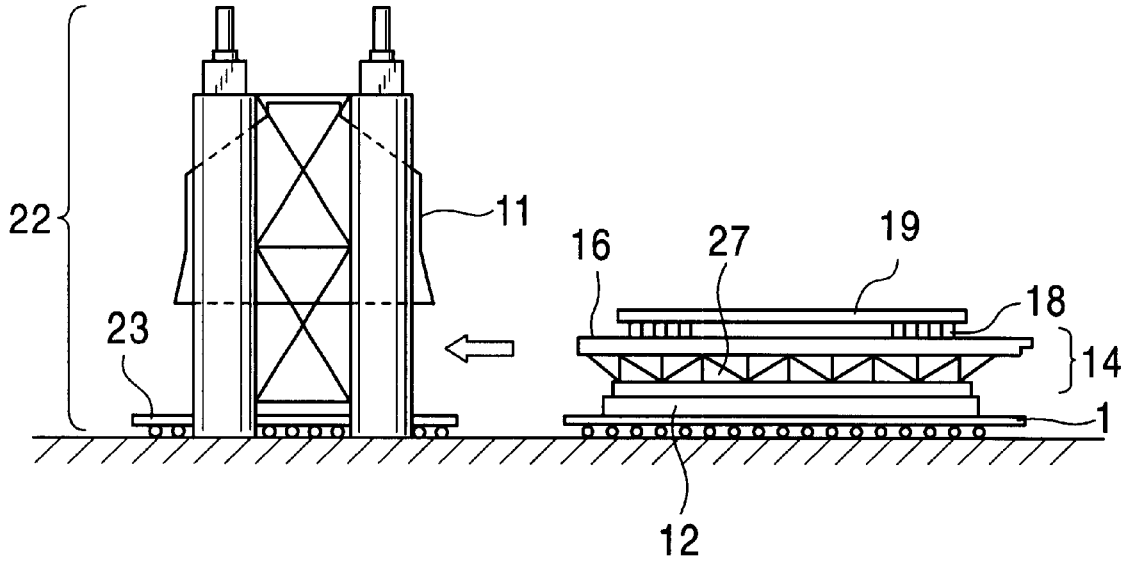
FIG. 25 is a side view according to this invention showing a situation where a furnace-body carriage cars including the load level-adjusting frameworks positioned thereon are moved into under the new furnace-body ring block lifted up by the movable lifting transfer apparatus.
Figure 26:
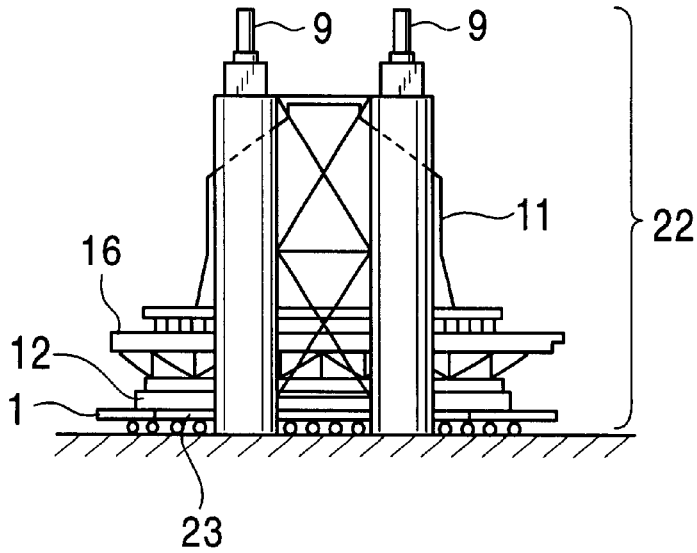
FIG. 26 is a side view according to this invention showing a situation where a new furnace-body ring block is lifted down by the movable lifting transfer apparatus and loaded on the load level-adjusting frameworks set on the furnace-body carriage cars.
Figure 27:
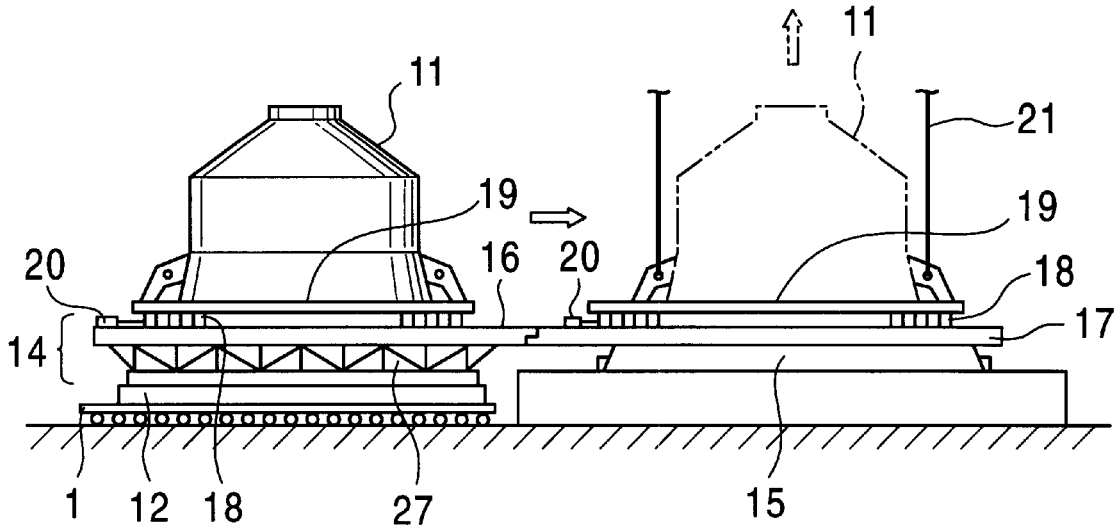
FIG. 27 is a side view according to this invention showing a situation where a new furnace-body ring block loaded on the load level-adjusting frameworks positioned on the furnace-body carriage cars is moved onto the foundation of a blast furnace body.

As shown in FIG. 23, the movable lifting transfer apparatus 22 is moved to the position of the furnace-body ring block 11 placed on the rest stand 10, and is held stationary in a work site. The slings 24 suspending from the lift jacks 9 are connected to hanger brackets 13 attached to the furnace-body ring block 11 at a lower end of its side. Thereafter, as shown in FIG. 24, the lift jacks 9 are driven to lift up the furnace-body ring block 11 from the rest stands 10 with the slings 24 and keep the furnace-body ring block 11 hung at a level of about 7 meters or more above the ground surface. Subsequently, as shown in FIG. 25, the furnace-body carriage cars 1 including the load level-adjusting framework 14 positioned thereon are moved below the hung furnace-body ring block 11, in the direction of the arrow in FIG. 25. As shown in FIG. 26, the lift jacks 9 are thereafter driven reversely to lower the furnace-body ring block 11, whereby the furnace-body ring block 11 is loaded on the load level-adjusting frameworks 14 positioned on the furnace-body carriage cars 1. Further, as shown in FIG. 27, the furnace-body carriage cars 1 are moved to a position near the foundation 15 of the blast furnace body, and the rails 16 provided on the load level-adjusting frameworks 14 are connected to the rails 17 provided on the foundation 15 of the blast furnace body. The movable platform 19 including the support blocks 18 disposed on the underside thereof is positioned on the rails 16, and the furnace-body ring block 11 placed on the movable platform 19 is moved horizontally in a direction of arrow while sliding over the rails 16, 17 with operation of the drive cylinders 20. The furnace-body ring block 11 is finally positioned at the center of the foundation 15 of the blast furnace body. Subsequently, the furnace-body ring block 11 is lifted up with the slings 21 suspending from the lift equipment provided on the posts of the blast furnace body to such a level that there is space enough for allowing another furnace-body ring block to be next transported to move onto the foundation 15 of the blast furnace body, below the previously lifted furnace-body ring block 11. After that, the next furnace-body ring block 11 in the sequence is moved under the preceding lifted-up furnace-body ring block 11. These two upper and lower furnace-body ring blocks 11 are joined together and then further lifted up. The blast furnace body is completed by repeating the above-described steps a number of times corresponding to the number of ring blocks newly fabricated, and integrating the stacked ring blocks into an integral structure on the foundation 15 of the blast furnace body.

In another embodiment of the present invention, a lifting transfer apparatus is employed which has a structure enabling positions of lift-up jacks to be freely moved so that the jacks can be positioned in vertically aligned relation to the positions at which each furnace-body ring block 11 is hung. Employing such a lifting transfer apparatus eliminates the need of performing horizontal level adjustment and using a hanger beam in the step of hanging the furnace-body ring block, and hence improves the efficiency of blast furnace body construction for dismantling and assembling a blast furnace body by dividing the furnace body from a top section to a hearth section into a plurality of furnace-body ring blocks.

Figure 28A:
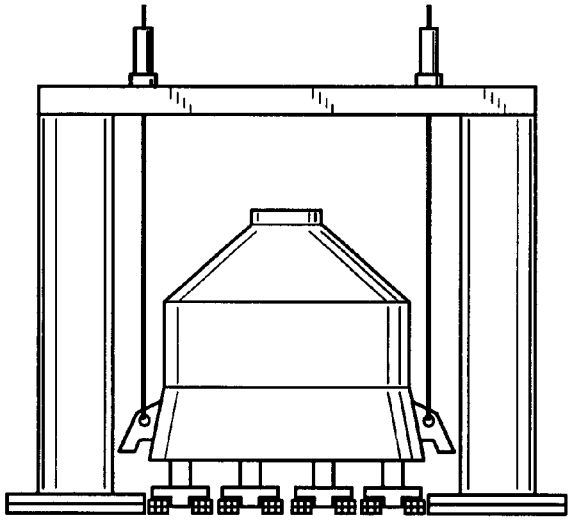
FIGS. 28A and 28B show one example of a lifting transfer apparatus having displaceable lifting units according to another embodiment of the present invention, i.e.
Figure 28B:
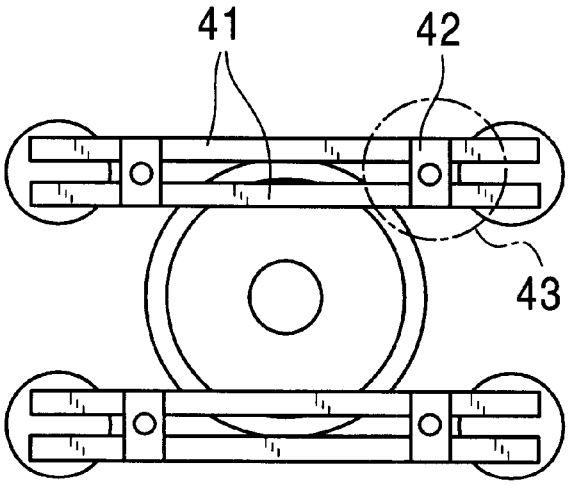
Figure 29A:
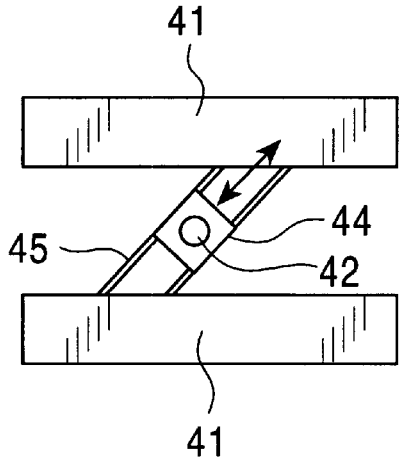
FIGS. 29A and 29B and 29C show a lifting-unit displacing mechanism for use in the another embodiment of the present invention, i.e.
Figure 29B:
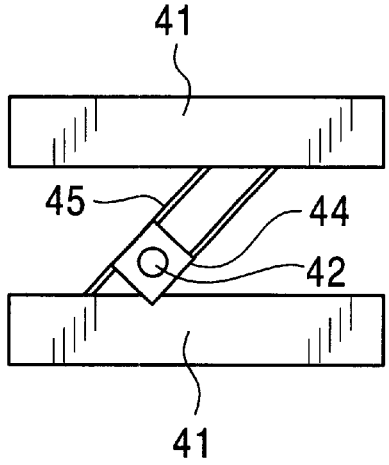
Figure 29C:
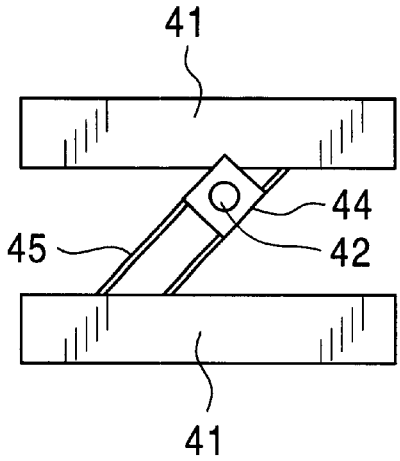

FIGS. 28A and 28B and 29A, 29B and 29C show one example of the lifting transfer apparatus according to this embodiment. FIG. 28A is a front view of the lifting transfer apparatus and FIG. 28B is a plan view thereof. The lifting transfer apparatus is made up of four posts and two pairs of beams 41 each positioned to extend between two of the posts in parallel at top ends thereof, including lift jacks 42 mounted on the beams 41. FIG. 29A shows in detail a jack surrounding area 43 denoted in FIG. 28B. Each jack 42 and a jack stand 44 are provided on two jack support beams 45 slidably in a direction of the arrow in FIG. 29A. The jack support beams 45 are coupled at both ends to the two beams 41 in pair. For the furnace-body ring block having a small diameter across its hanging points, as shown in FIG. 29B, the jack 42 is slid over the jack support beams 45 toward the side nearer to the center of the furnace-body ring block. On the other hand, for a furnace-body ring block having a large diameter across its hanging points, as shown in FIG. 29C, the jack 42 is slid toward the side away from the center of the furnace-body ring block. In this way, the jacks can be easily and accurately positioned in vertically aligned relation to the respective hanging points for each ring block.

Figure 30A:
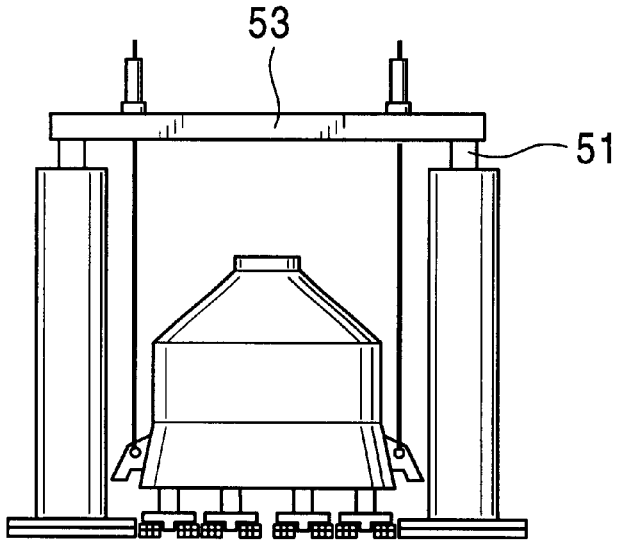
FIGS. 30A and 30B shows another example of the lifting transfer apparatus having displaceable lifting units according to the another embodiment of the present invention, i.e.
Figure 30B:
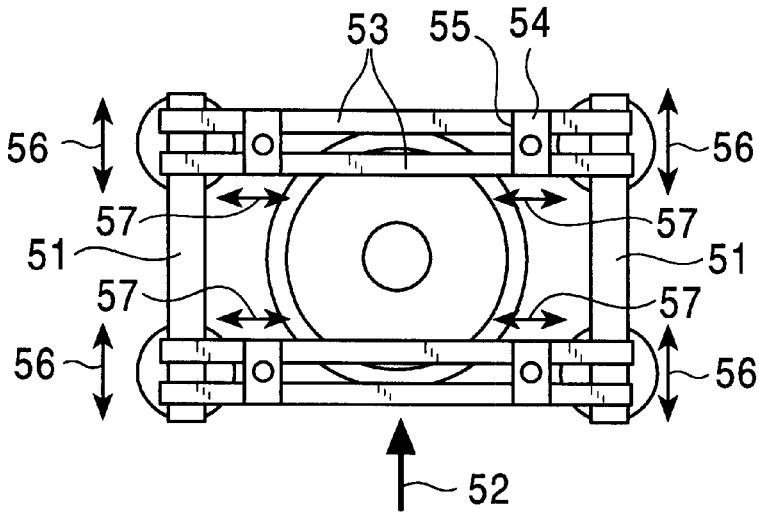

FIGS. 30A and 30B show another example of this embodiment of the present invention. FIG. 30A is a front view looking in the direction of movement of the furnace-body ring block and FIG. 30B is a plan view. Two beams 51 are each positioned to extend in the direction of movement of the furnace-body ring block, indicated by arrow 52, between two of four posts in parallel at top ends thereof. Two pairs of beams 53 are positioned on the beams 51 to extend perpendicularly to the direction of movement of the furnace-body ring block. The two pairs of beams 53 are slidable over the beams 51 in the direction of movement of the furnace-body ring block, as indicated by arrow 56 in FIG. 30B. Jacks 54 and jack stands 55 are provided on each pair of beams 53, allowing them to be slidable in a direction perpendicular to the direction of movement of the furnace-body ring block, as indicated by arrow 57 in FIG. 30B. With such an arrangement, the jacks can be moved to any desired positions and can be positioned in vertically aligned relation to respective hanging points of each ring block, as with the above example.

When practically reconstructing a blast furnace with capacity of as high as about 4000 $m^3$ dividing it into four parts, a period of about 70 days, which has heretofore been required to complete the entire construction process with the conventional ring block technique, can be cut down to about 65 days by employing the movable lifting transfer apparatus, to about 62 days by employing the lifting transfer apparatus with a structure enabling the positions of the lift-up jacks to be freely displaced, and to about 60 days by employing a lifting transfer apparatus having both the moving function and the hanging point displacing function.

The following and other advantages are obtained by employing the movable lifting transfer apparatus according to the present invention.

(1) Since dismantled furnace-body ring blocks and newly fabricated furnace-body ring blocks are both transported by the furnace-body carriage cars including the load level-adjusting frameworks always positioned thereon, the period required for the entire construction process of the blast furnace can be cut down.

(2) Since the movable lifting transfer apparatus can be moved simultaneously with the step of mounting the furnace-body ring block onto the foundation of the furnace body, the entire construction process can be further cut down.

(3) Since the movable lifting transfer apparatus can be moved to a furnace-body disassembly site, the dismantled furnace-body ring blocks can be placed directly on the furnace-body disassembly site.

(4) Since the newly fabricated furnace-body ring blocks can be lifted up directly in the furnace-body ground assembly site, there are no restrictions on the height of the rest stands and the positions at which the rest stands are arranged. Accordingly, low altitude rest stands can be employed, and the number and arrangement of the rest stands can be freely selected so as to minimize deformation of the furnace-body ring block assembled thereon.

Furthermore, the following benefits are obtained by employing a lifting transfer apparatus having a structure enabling the positions of the lifting jacks to be freely displaced according to the present invention.

(1) Regardless of changes in hanging points due to the size of each ring block, the lifting jacks can be always freely positioned in vertically aligned relation to the respective hanging points. Therefore, the risk of hanging the ring block in an inclined altitude is eliminated. In other words, it is possible to omit horizontal leveling work that has hitherto been required, and to cut down valuable working time.

(2) An expensive hanger beam is no longer required. The time taken for adjusting the block hanging positions when using the hanger beam can be cut down significantly.

What is claimed is:

1. A method of constructing a blast furnace body, by dismantling and assembling said blast furnace body in a shortened period of time and at reduced cost, wherein said blast furnace body is divided into a top section, a hearth section and a plurality of intervening furnace-body ring block sections, said method comprising the steps of:

connecting a foundation of said blast furnace body to a furnace-body carriage car having a loading level substantially aligned with said foundation of said blast furnace body, moving each of said furnace-body ring blocks between said foundation and said furnace-body carriage car; and moving by a lifting transfer apparatus each of said furnace-body ring blocks between said furnace-body carriage car and a furnace-body assembly position, wherein said lifting transfer apparatus is movable.

2. The method of constructing a blast furnace body according to claim 1, wherein said movable lifting transfer apparatus comprises a plurality of spaced-apart lifting jacks.

3. A lifting transfer apparatus for lifting and transferring each of a plurality of furnace-body ring blocks obtained by dividing a blast furnace body into a top section, a hearth section and intervening sections, said lifting transfer apparatus comprising a support for a plurality of lifting jacks, wherein said support has a movable body, and means for moving said lifting transfer apparatus.

4. The lifting transfer apparatus according to claim 3, wherein said support comprises:

a plurality of posts arranged substantially at the comers of a substantially rectangular zone, wherein said posts are positioned to provide spans that extend from post to post, two of said spans being longer and two of said spans being shorter;

a pair of substantially horizontal beams, wherein each of said beams is positioned to extend between top ends of a pair of said posts having a longer span between said paired posts; and a plurality of lift jacks disposed on each of said horizontal beams, wherein said posts comprise lower ends having substantially rectangular grooves, wherein said grooves open downwardly and extend along a substantially horizontal line connecting centers of each pair of said posts having said shorter span between said paired posts; and wherein said means for moving said lifting transfer apparatus comprises:

a lifting-transfer-apparatus carriage car comprising a load level-adjusting framework positioned beneath a furnace-body ring block suspended by said lifting transfer apparatus, wherein said furnace-body ring block is in position to be either loaded or unloaded, wherein said lifting transfer apparatus carriage car is positioned in said grooves, wherein said lifting transfer apparatus carriage car further comprises a substantially flat upper surface and wherein said lifting transfer apparatus carriage car is able to freely raise and lower said surface and to change movement direction, and wherein said lifting transfer apparatus carriage car contacts each said pair of posts when said upper surface of said carriage car is raised, and further wherein said carriage car disengages from each said pair of posts when the upper surface of said carriage car is lowered.

5. A lifting transfer apparatus for lifting and transferring each of a plurality of furnace-body ring blocks obtained by dividing a blast furnace body into a top section, a hearth section and intervening sections when said blast furnace body is dismantled or assembled, said lifting transfer apparatus including a lifting mechanism, wherein said lifting mechanism is movable relative to said furnace-body ring blocks.

6. The lifting transfer apparatus according to claim 5, wherein said lifting mechanism comprises a lifting jack, wherein said furnace-body ring block comprises a hanging connector wherein said hanging connector is engageable to lift and lower said furnace-body ring block, wherein said lifting jack is mounted on a support for horizontally slidable movement, and wherein said lifting jack is adjustably positionable in vertically aligned relation to said corresponding hanging point of said furnace-body ring block to be lifted.

7. A lifting transfer apparatus for lifting and transferring each of a plurality of furnace-body ring blocks obtained by dividing a blast furnace body, including a top section, intervening sections and a hearth section in order to dismantle and assemble the blast furnace, said lifting transfer apparatus comprising a movable support and a movable lifting mechanism.

8. The lifting transfer apparatus according to claim 4, wherein said posts are in the shape of cylindrical columns.

9. The lifting transfer apparatus according to claim 4, comprising a structural connecting member positioned to extend between a pair of said posts having a shorter span between said paired posts.

* * * * *